United States Patent [19]

Eschard

[11] Patent Number: 4,731,559

[45] Date of Patent: Mar. 15, 1988

[54] ELECTRON MULTIPLIER PLATE WITH CONTROLLED MULTIPLICATION

[75] Inventor: Gilbert Eschard, Brive La Gaillarde, France

[73] Assignee: U.S. Philips Corporation, New York, N.Y.

[21] Appl. No.: 924,224

[22] Filed: Oct. 28, 1986

[30] Foreign Application Priority Data

Jun. 3, 1986 [FR] France ..... 86 07966

[51] Int. Cl.[4] ..... H01J 43/00

[52] U.S. Cl. ..... 313/533; 313/103 R; 313/103 CM; 313/105 CM

[58] Field of Search ..... 313/533, 532, 534, 535, 313/536, 103 R, 103 CM, 105 R, 105 CM

[56] References Cited

U.S. PATENT DOCUMENTS 4,184,098 1/1980 Morales ..... 313/535
4,482,836 11/1984 Washington et al. ..... 313/105 CM
4,612,483 9/1986 Washington ..... 313/105 CM
4,649,268 3/1987 Persyk ..... 313/105 R X

*Primary Examiner*—David K. Moore
*Assistant Examiner*—Mark R. Powell
*Attorney, Agent, or Firm*—F. Brice Faller

[57] ABSTRACT

Electron multiplier plate with controlled multiplication, multiplier element comprising the said plate, multiplier device comprising the said element and application of the said device to a photomultiplier tube.

Secondary emission electron multiplier plate (10) of the "aperture plate" type, comprising multiplier apertures (11), each having an input side (12), an output side (13), and an efficacious multiplier partition (14) having emissive power. Multiplier plate (10) has at least one elementary multiplier pattern (15) comprising a plurality of multiplier apertures, at least the said efficacious multiplier partitions (14*a*) of the peripheral multiplier apertures (11*a*) of the pattern (15) being oriented towards the interior of the said pattern.

10 Claims, 11 Drawing Figures

ELECTRON MULTIPLIER PLATE WITH CONTROLLED MULTIPLICATION

BACKGROUND OF THE INVENTION

The present invention relates to a secondary emission electron multiplier plate of the "aperture plate" type, comprising apertures, termed multiplier apertures, having an input side, and output side, and an efficacious multiplier partition having emissive power.

The invention also relates to an electron multiplier element comprising a multiplier plate according to the invention, an electron multiplier device composed of such multiplier elements, and an application of the multiplier device to a photomultiplier tube.

The invention is advantageously used in the field of photomultiplier tubes.

French Patent Specification No. 2 549 288 discloses a multiplier plate constituted by a plurality of equivalent multiplier apertures disposed according to a regular flat system. However when used in certain devices comprising several superimposed plates defining homologous electron channels, such a multiplier plate does not prevent the interaction between electrons issued from different channels. During the operation of a multi-anode photomultiplier tube comprising several superimposed plates of this type, this interaction leads to the provision of partitions which are impervious to electrons.

SUMMARY OF THE INVENTION

It is the object of the present invention to provide a multiplier plate having multiplier apertures arranged to constitute homologous electron channels without interactions between various channels.

According to the present invention, a secondary emission electron multiplier plate of the "aperture plate" type includes apertures, termed multiplier apertures, presenting an input side, an output side, and an efficacious multiplier partition having emissive power, that is, having good secondary emission properties. The multiplier plate is composed of at least one elementary multiplier pattern comprising a plurality of multiplier apertures, at least the efficacious multiplier partitions of the peripheral multiplier apertures of the pattern being oriented so that electrons are directed towards the interior of the pattern through the output side.

In this manner multiplication is preferably directed towards the centre of the pattern since, due to the orientation of their efficacious multiplier partitions, at least the peripheral multiplier apertures have for their effect to transport the incident electrons falling on the periphery of the pattern towards the interior of the pattern.

In order to symmetrise the geometry of the elementary pattern it has a symmetry axis of rotation of the order n perpendicular to the multiplier plate and the multiplier apertures of the pattern follow n to n by rotation of $2\pi/n$ around the said axis.

In order to increase the collection efficacy of the multiplier plate, at least the peripheral multiplier apertures of the elementary multiplier pattern are such that the straight projection of their output side on a plane parallel to the multiplier plate is at least partially situated on the interior of the corresponding projection of their input side. The greater part of the incident electrons arriving at least on the periphery of the elementary pattern thus impinge with a greater probability on the partition of the multiplier aperture and undergo there a multiplication, resulting in an improved collector power of the plate.

The electron multiplier plate according to the invention may be used to produce an electron multiplier element which also comprises a second metallic plate, parallel to the said multiplier plate, having holes termed auxiliary holes, disposed oppositely to the output sides of the multiplier apertures, the second metallic plate electrically insulated from the multiplier plate being brought to an electric potential which is higher than the electric potential of the multiplier plate. The second metallic plate thus plays the role of accelerating electrode.

For the parallel stacking of several multiplier elements according to the invention it is possible to manufacture an electron multiplier device such that each elementary multiplier aperture of the multiplier plate of the $i^{th}$ multipler element is disposed oppositely to an elementary multiplier pattern of the multiplier plate of the $(i+1)^{th}$ multiplier element to form a series of homologous elementary multiplier patterns, and that the output side of the multiplier apertures of the multiplier plate of the $i^{th}$ multiplier element is placed oppositely to the efficacious multiplier partition of a multiplier aperture of the multiplier plate of the $(i+1)^{th}$ multiplier element. By the superposition of homologous multiplier patterns the multiplier device presents the advantage of channeling the electrons within channels defined by the series of homologous elementary patterns without the possibility of interaction between a channel and an adjacent channel. This advantage may notably be used to realise a multiplier tube comprising a photocathode and n adjacent anodes. In this appliation, the multiplier device is placed in the proximity of the photo cathode, and the homologous elementary multiplier patterns of the device are placed oppositely to one of the adjacent anodes so as to realise n secondary multiplier tubes in the same photomultiplier tube. So it is no longer necessary to provide particular means, such as tight partitions, to avoid the covering of electrons belonging to one or the other of the secondary photomultiplier tubes.

DETAILED DESCRIPTION OF THE PREFERRED EMBODIMENTS

Figure 1A:
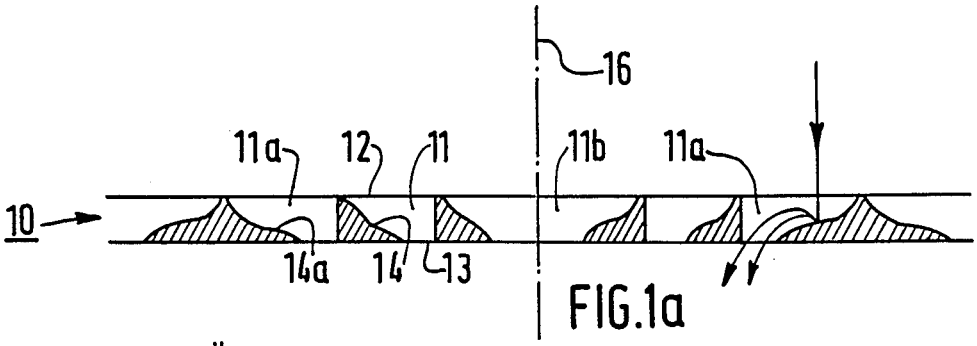
FIG. 1*a* is a sectional view taken along line I—I of FIG. 1*b.
Figure 1B:
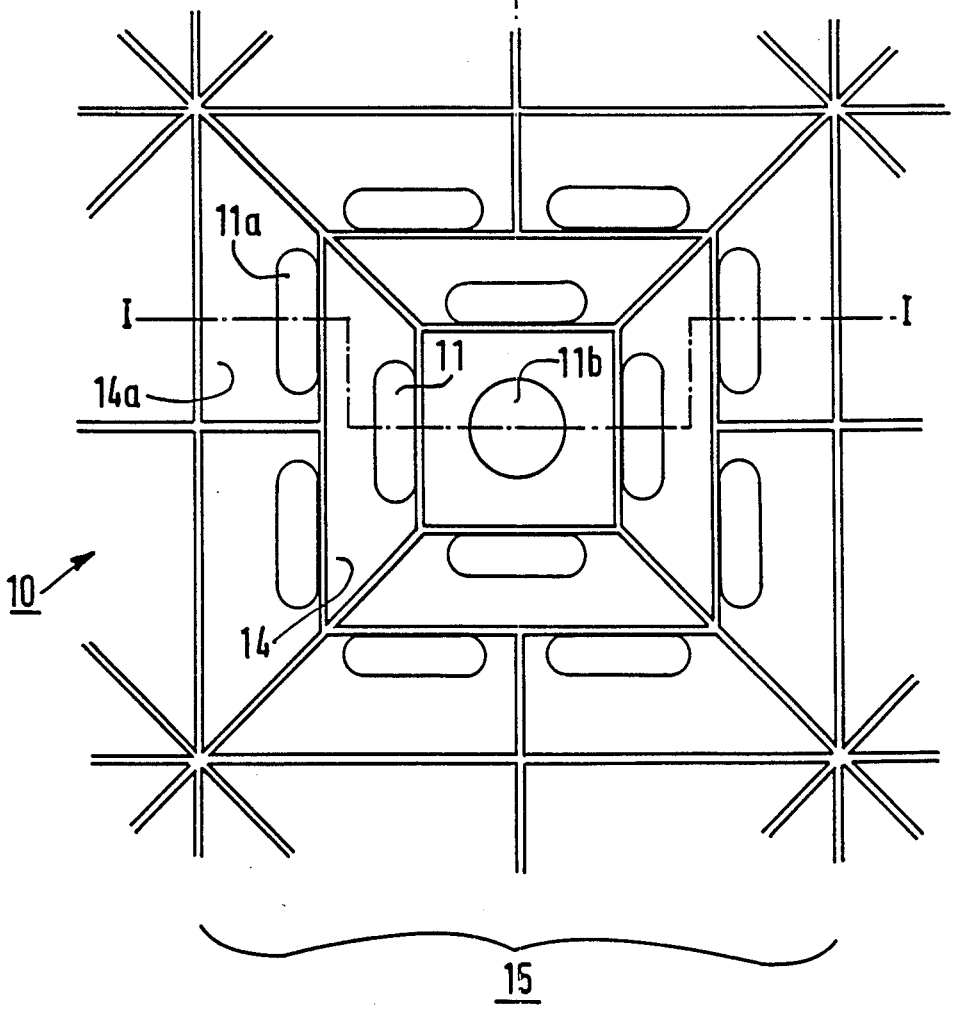
* FIG. 1*b* is a plan view of a first embodiment of a multiplier plate according to the invention.

FIGS. 1*a* and 1*b* show a secondary emission electron multiplier plate 10 of the "apertured plate" type, comprising apertures 11, termed multiplier apertures, having an input side 12, an output side 13 and an efficacious multiplier partition 14 having emissive power. To this end the multiplier plate 10 is manufactured from a material having secondary emission, for example, an alloy of copper-beryllium, after heating, which has been heated to cause migration of the beryllium and oxidation. It may also be manufactured from a less expensive material, for example, mild steel, covered by a secondary emission material; a layer of an alloy of oxidised copper-beryllium or a layer of manganese oxide. As is shown in FIG. 1*b*, the multiplier plate 10 is composed of at least one elementary multiplier pattern 15 comprising a plurality of multiplier apertures 11, at least the efficacious multiplier partitions 14*a* of the peripheral multiplier apertures 11*a* of the pattern 15 being oriented so that electrons are directed towards the interior of the pattern through the output side. The efficacious partitions of all the multiplier apertures are oriented towards the interior of the pattern 15. Efficacious partitions are the partitions of the multiplier apertures capable of producing secondary emission, that is to say those on which the incident electrons are going to impinge.

This particular configuration of the multiplier plate enables the pattern to direct the multiplication towards the interior of the same pattern and hence to concentrate the emitted secondary electrons while avoiding their dispersion towards the exterior of the pattern.

As shown in FIGS. 1 and 2, elementary multiplier pattern 15 has a symmetry axis 16 of rotation of the order $n=4$, perpendicular to the multiplier plate 10, such that the multiplier apertures 14 of the pattern follow 4 to 4 by rotation of $\pi/2$ around the said axis 16.

Figure 2A:
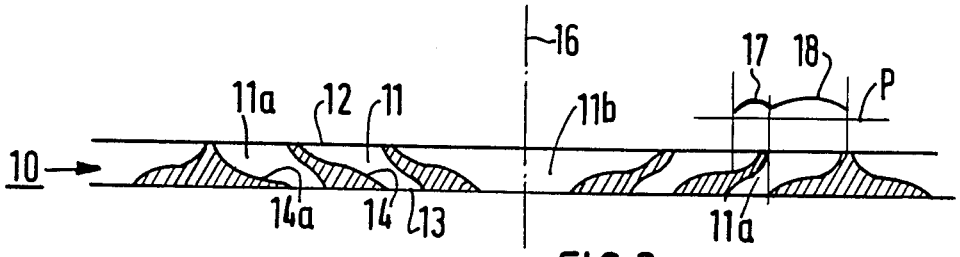
FIG. 2*a* is a sectional view taken along line line II—II of FIG. 2*b.
Figure 2B:
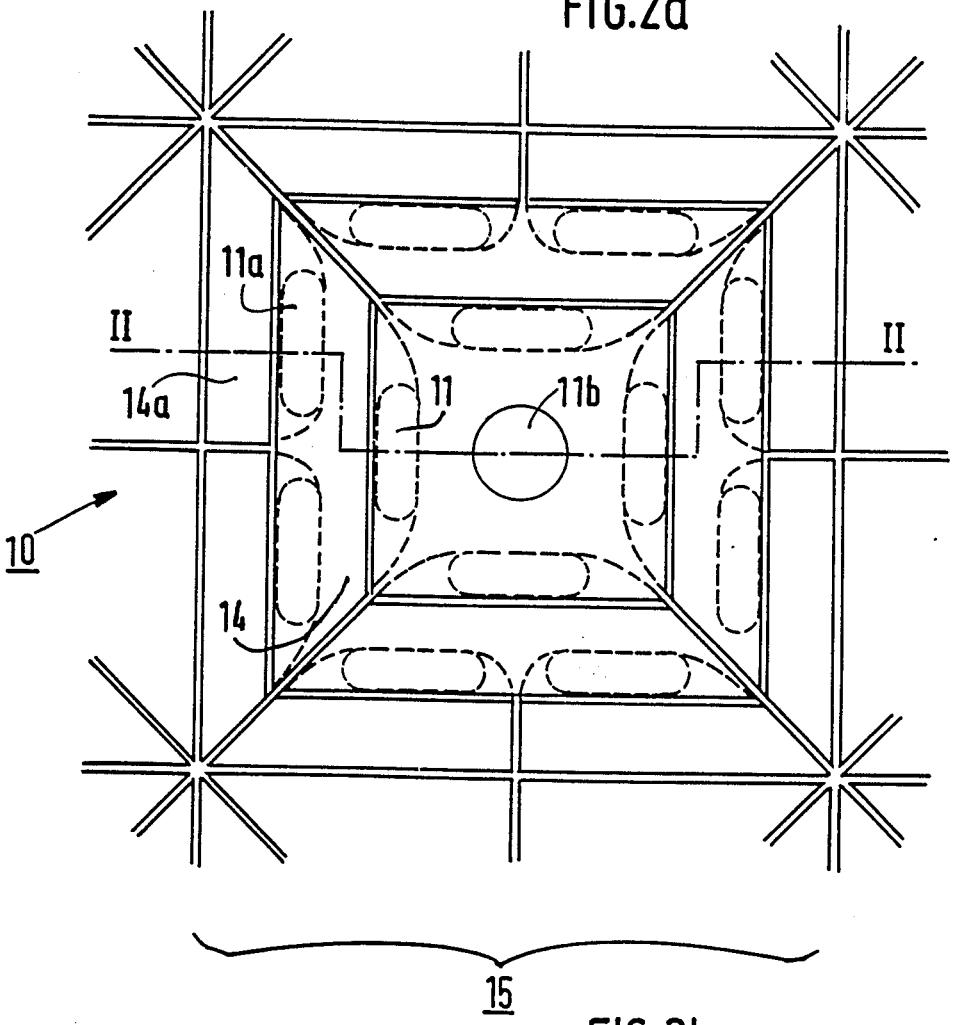
* FIG. 2*b* is a plane view of a second embodiment of a multiplier plate according to the invention.

FIGS. 2*a* and 2*b* show a second embodiment of an electron multiplier plate 10 in which at least the peripheral multiplier apertures 14*a* of the elementary pattern 15 are such that the straight projection 17 of their output side 13 on a plane P parallel to the multiplier plate 10 is, at least partially, in this case entirely, situated on the interior of the projection 18 corresponding to their input side 12. This structure presents to the incident electrons whose angle of incidence is not too large a more important capturing surface by the efficacious partition 14*a*. In other words, the greater part of the electrons penetrating at least in the peripheral multiplier apertures 11*a* through the input side 12 will not be able to leave directly through the output side 13 but will give rise to secondary emission thus contributing to a considerable increase of the efficacy of collection of the multiplier plate 10.

Figure 3A:
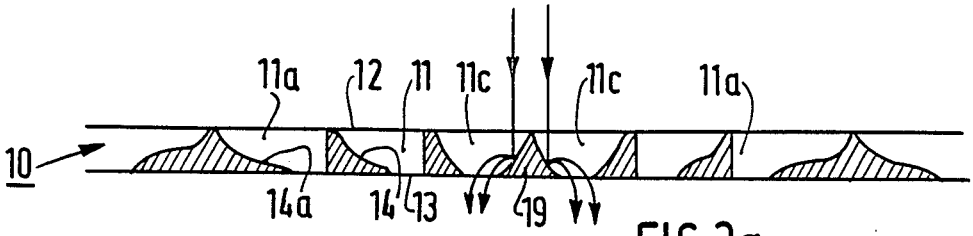
FIG. 3*a* is a sectional view taken along line I—I of FIG. 3*b.
Figure 3B:
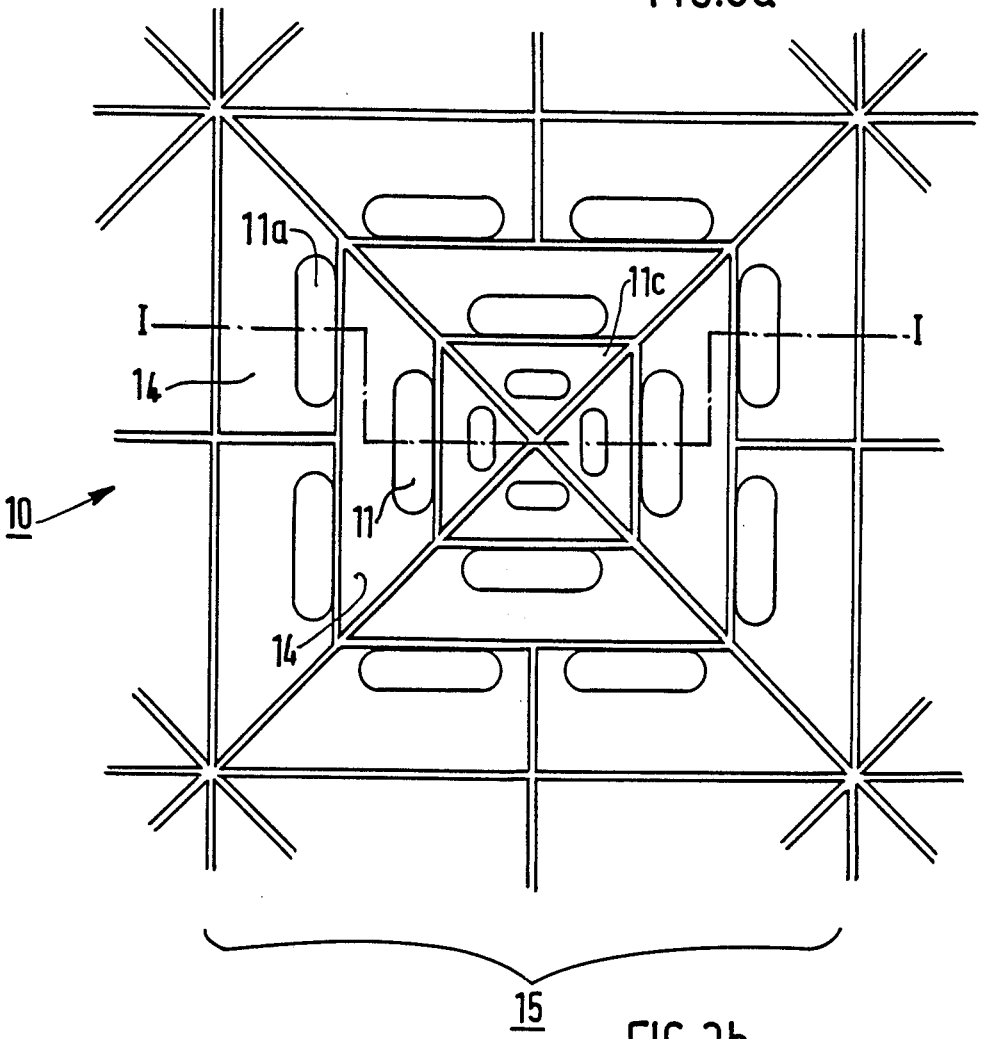
* FIG. 3*b* is a plan view of a modified embodiment of the multiplier plate of FIG. 1.

Thus, as may be seen from FIGS. 1 and 2, an embodiment of the multiplier plate 10 is such that the centre of the elementary multiplier pattern 15 is occupied by a central multiplier aperture 11*b*. Conversely, the modified embodiments shown in FIGS. 3 and 4 have, in the centre of the elementary multiplier pattern 15, a central metallic part 19 having emissive power, providing a portion of the said efficacious multiplier partition 14 of each of the multiplier apertures 11*c* situated most in the centre of the pattern 15.

Figure 4A:
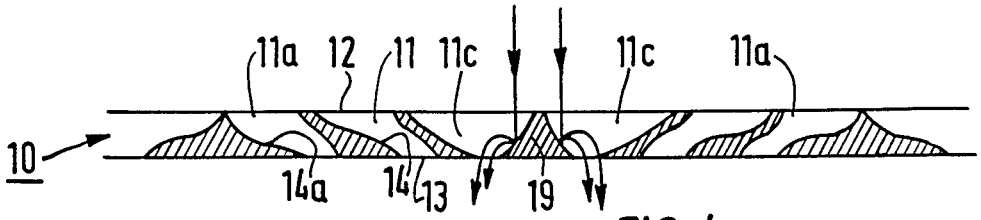
FIG. 4*a* is a sectional view taken along line II—II of FIG. 4*b.
Figure 4B:
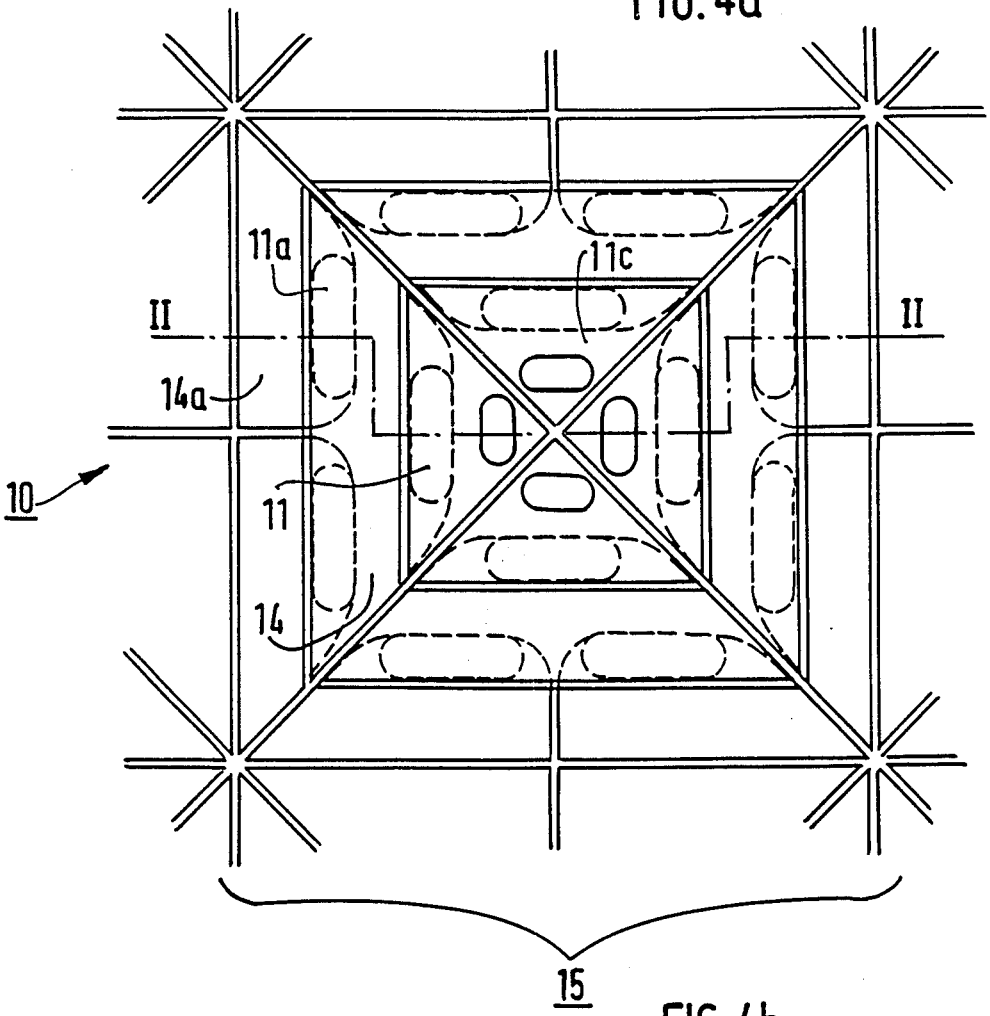
* FIG. 4*b* is a plan view of a modified embodiment of the multiplier plate of FIG. 2.
Figure 5:
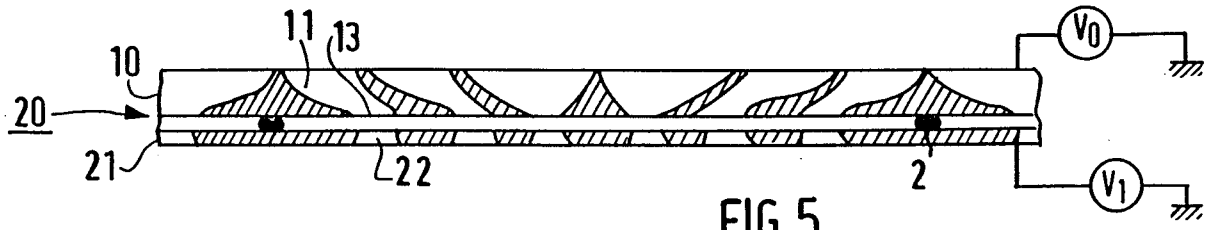
FIG. 5 is a sectional view of a multiplier element according to the invention.

FIG. 5 is a sectional view of an electron multiplier element 20 comprising a multiplier plate 10 of the type described with reference to FIG. 4. As shown in FIG. 5, the multiplier element 20 also comprises a second metallic plate 21 parallel to the multiplier plate 10 and pierced with holes 22, termed auxiliary holes, disposed oppositely to the output sides 13 of the multiplier apertures 11. Moreover, the second metallic plate 21 is insulated electrically from the multiplier plate 10 and is brought to an electric potential V1 higher than the potential V0 of the said multiplier plate. The electric insulation between the multiplier plate 10 and the second metallic plate 21, serving as accelerating electrode, is realised, for example, by means of small glass balls 2, diameter 100 to 200 $\mu$m, sealed to the periphery of the plates.

Figure 6:
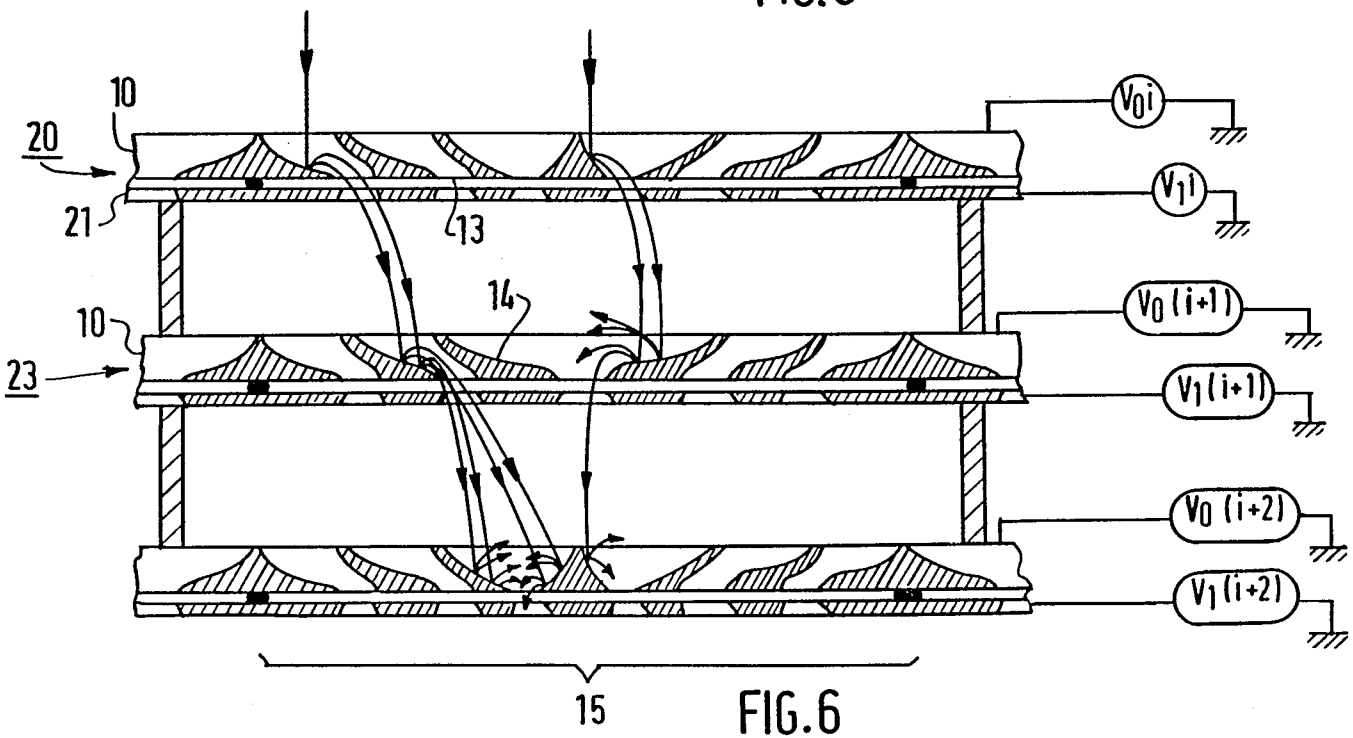
FIG. 6 is a sectional view of a multiplier element according to the invention.

FIG. 6 is a sectional view of an electron multiplier device 23 constituted by a parallel stack of multiplier elements 20 manufactured, for example, by superimposing in an alternating manner multiplier elements comprising a multiplier plate of the type shown in FIG. 4 and multiplier elements comprising a multiplier plate of the type shown in FIG. 2. As indicated in FIG. 6, each elementary multiplier pattern 15 of the multiplier plate 10 of the $i^{th}$ multiplier element 20 is disposed oppositely to an elementary multiplier pattern 15 of the multiplier plate of the $(i+1)^{th}$ multiplier element in order to form a series of homologous elementary multiplier patterns. On the other hand, the output side 13 of the multiplier apertures of the multiplier plate 10 of the $i^{th}$ multiplier element is placed oppositely to the efficacious multiplier partition 14 of a multiplier element of the multiplier plate of the $(i+1)^{th}$ multiplier element; this latter disposition ensures a minimum loss of collection of one multiplier element to the other. Finally, the electric potentials applied are such that the second metallic plate 21 of the $i^{th}$ multiplier element 20 is brought at an electric potential V1i identical to the potential $V0(i+1)$ of the multiplier plate 10 of the $(i+1)^{th}$ multiplier element. So we have the equalities:

$$V1(i)=V0(i+1) \text{ and } V1(i+1)=V0(i+2)$$

Figure 7:
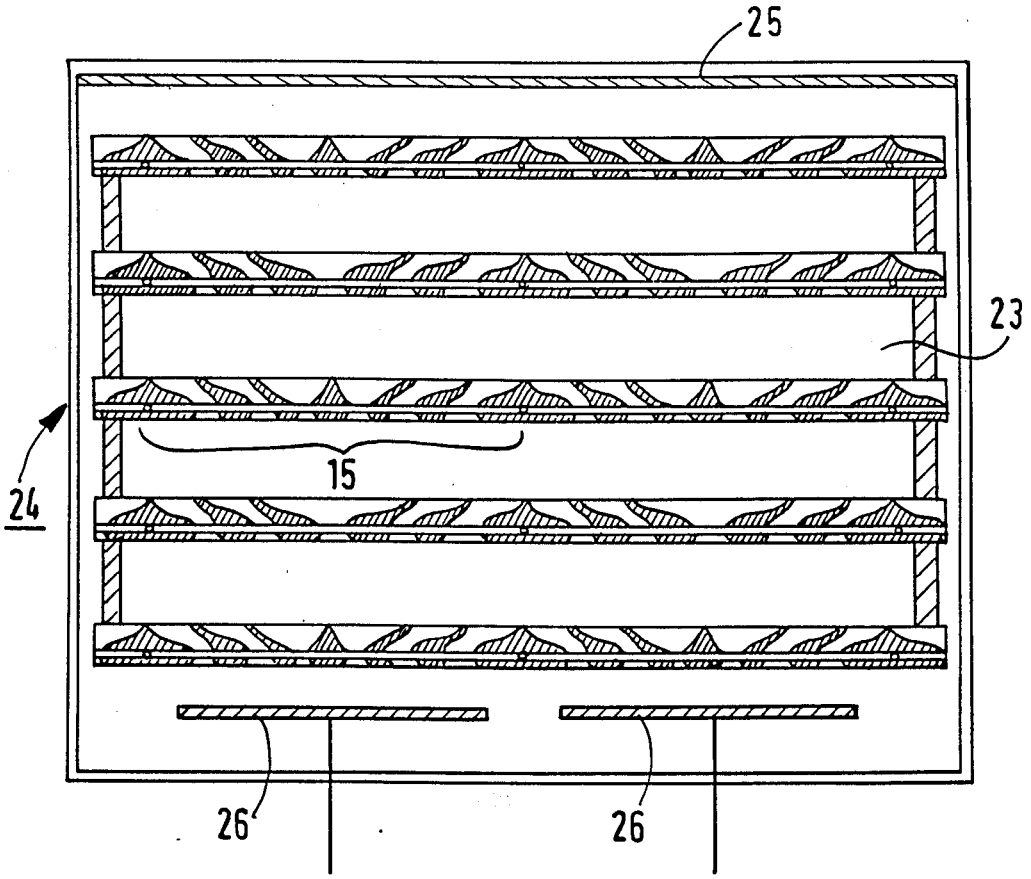
FIG. 7 is a sectional view of a photomultiplier tube comprising the multiplier device of FIG. 6.

As a result of the possibility which the multiplier device of FIG. 5 presents to realise independent electron channels, a particularly advantageous application thereof lies in the field of photomultiplier tubes, notably multiple anode proximity focusing tubes. FIG. 7 is a sectional view of a photomultiplier tube 24 comprising a photocathode 25 and n (in this case $n=2$) adjacent anodes 26. The multiplier device 23 is placed in the proximity of the photo-cathode 25 and the homologous multiplier patterns 15 are disposed oppositely to one of the adjacent anodes 26 in order to realise 2 secondary photomultiplier tubes in the same photomultiplier tube 24. As may be seen from FIG. 7, the photomultiplier tube 24 does not require any mechanical separation between the adjacent elementary patterns since the very conception of the multiplier plates inhibits any covering between electrons issued by different patterns. The photomultiplier tube of FIG. 7 may advantageously be used in nuclear physics for the precise localisation of elementary particles.

What is claimed is:

1. A secondary emission electron multiplier plate of the "apertured plate" type, comprising an elementary multiplier pattern having a plurality of multiplier apertures, said apertures lying in concentric arrays about the interior of said pattern, each aperture having an input side, an output side, and an efficacious multiplier partition having emissive power therebetween, the partitions of the apertures in the peripheral array being oriented so that electrons received at their input sides are directed toward the interior of the pattern through the output side.

2. An electron multiplier plate as claimed in claim 1, characterized in that the elementary multiplier plate (15) has an axis (16) of symmetry of rotation through the interior of the pattern perpendicular to the multiplier plate (10), the pattern of multiplier apertures (14) repeating upon rotation of $2\pi/n$ around the axis (16), where n is an integer 2 or greater.

3. An electron multiplier plate as in claim 1 wherein at least the peripheral multiplier apertures (14*a*) of the elementary multiplier pattern (15) are such that the straight projection (17) of their output side (13) on a plane parallel (P) to the multiplier plate (10) is at least partially situated inside the corresponding projection (18) of their input side (12).

4. An electron multiplier plate as in claim 1 wherein the centre of the elementary multiplier pattern (15) is occupied by a multiplier aperture, termed central multiplier aperture (11*b*).

5. An electron multiplier plate is in claim 1 wherein the centre of the elementary multiplier pattern (15) is occupied by a central metallic part (19) having emissive power, supplying a portion of the efficacious multiplier partition (14) of each of the multiplier apertures (11*c*) situated more towards the centre of the pattern (15).

6. An electron multiplier element (20) comprising a multiplier plate (10) in claim 1 wherein it also comprises a second metallic plate (21), parallel to the said multiplier plate (10), having holes (22), termed auxiliary holes, disposed oppositely to output sides (13) of the multiplier apertures (11), the second metallic plate (21) electrically insulated from the multiplier plate (10), being brought at an electric potential (V1) higher than the electric potential (V0) of the said multiplier plate.

7. An electron multiplier device (23) comprising a parallel stack of a plurality of multiplier elements as claimed in claim 6, characterized in that each elementary multiplier pattern (15) of the multiplier plate (10) of the $i^{th}$ multiplier element is disposed opposite an elementary multiplier pattern of the multiplier plate of the $(i+1)^{th}$ multiplier element so as to form a series of homologous elementary multiplier patterns, and in that the output side (13) of the multiplier apertures of the multiplier plate of the $i^{th}$ multiplier element is placed oppositely to the efficacious multiplier partition (14) of a multiplier aperture of the multiplier plate of the $(i+1)^{th}$ multiplier element, where i is an integer 1 or greater.

8. An electron multiplier device as claimed in claim 7, characterized in that the parallel stack of multiplier elements (20) is realized by the alternated superposition of multiplier elements comprising a multiplier plate wherein the center of the elementary multiplier pattern is occupied by a central metallic part having emissive power supplying a portion of the efficacious multiplier partition of each of the multiplier apertures situated toward the center of the pattern, and of multiplier elements comprising a multiplier plate having a multiplier aperture at the center of the elementary multiplier pattern.

9. An electron multiplier device as in claim 7 wherein the second metallic plate (21) of the $i^{th}$ multiplier element is brought at an electric potential (V1(i)) identical to the electric potential (V0(i+1)) of the multiplier plate (10) of the $(i+1)^{th}$ multiplier element.

10. Application of an electron multiplier device as in claim 7 a multiplier tube (24) comprising a photo cathode (25) and n adjacent anodes (26), characterized in that, the said multiplier device (23) being placed in the proximity of the photo cathode (25), the homologous elementary multiplier patterns (15) of the said device are placed oppositely to one of the said adjacent anodes (26) so as to realize n secondary photomultiplier tubes in the same photomultiplier tube (24).

* * * * *